United States Patent [19]

Böcker et al.

[11] Patent Number: 4,951,572

[45] Date of Patent: Aug. 28, 1990

[54] WARHEAD WITH DEVICE FOR FASTENING THE LINER OF A CHARGE TO THE CASING

[75] Inventors: Jürgen Böcker, Oberhausen; Hans Orth, Dusseldorf; Torsten Niemeyer, Hilden; Peter Tripptrap, Langenfeld, all of Fed. Rep. of Germany

[73] Assignee: Rheinmetall GmbH, Düsseldorf, Fed. Rep. of Germany

[21] Appl. No.: 461,276

[22] Filed: Jan. 5, 1990

[30] Foreign Application Priority Data

Jan. 19, 1989 [DE] Fed. Rep. of Germany ..... 3901474

[51] Int. Cl.[5] ..... F42B 12/10

[52] U.S. Cl. ..... 102/476; 102/307

[58] Field of Search ..... 102/306, 307, 308, 309, 102/310, 476

[56] References Cited

U.S. PATENT DOCUMENTS 3,437,036 4/1969 Franzen et al. .

3,978,795 9/1976 Strunk et al. .

4,703,695 11/1987 Langer .

FOREIGN PATENT DOCUMENTS 2113362 7/1983 United Kingdom ..... 102/476

*Primary Examiner*—Charles T. Jordan

*Assistant Examiner*—Richard W. Wendtland

*Attorney, Agent, or Firm*—Spencer & Frank

[57] ABSTRACT

A warhead for enclosing an explosive charge includes a casing for surrounding the charge. The casing has an end presenting a frontal face. A liner having a circumferential area for attachment to the end of the casing and a coefficient of thermal expansion $\alpha_R$ is fastened to the casing by way of an intermediate ring connected to the circumferential area of the liner. The intermediate ring has a portion which is brought around the frontal face of the casing and which has a pressure face which presses against the exterior of the casing. The liner has a coefficient of thermal expansion $\alpha_E$ which is at least as great as the coefficient of thermal expansion $\alpha_R$ of the intermediate ring.

11 Claims, 2 Drawing Sheets

FIG. 5
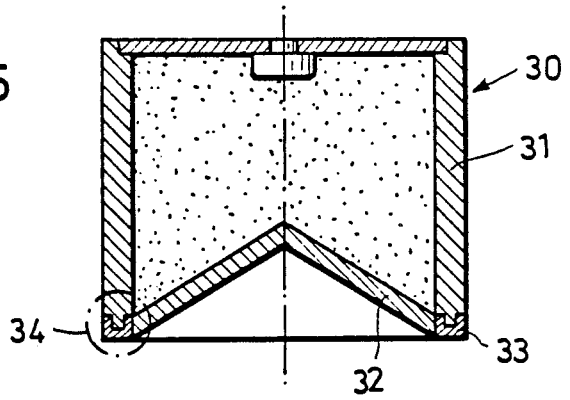
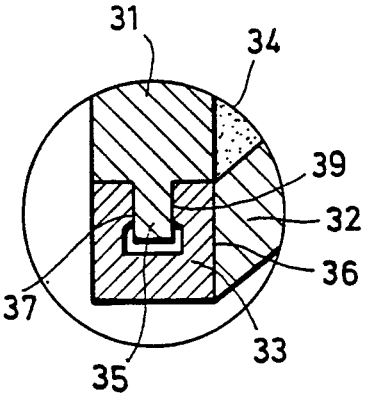
FIG. 6
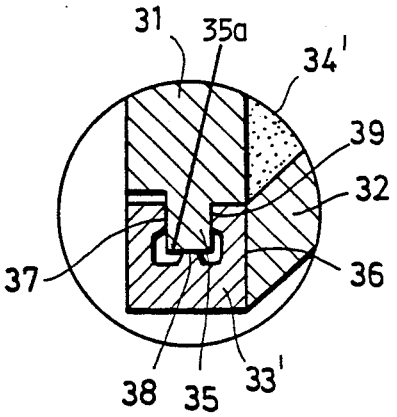
FIG. 7

WARHEAD WITH DEVICE FOR FASTENING THE LINER OF A CHARGE TO THE CASING

CROSS REFERENCE TO RELATED APPLICATION

This application claims the priority of application Ser. No. P 39 01 474.6, filed Jan. 19th, 1989, in the Federal Republic of Germany, the subject matter of which is incorporated herein by reference.

BACKGROUND OF THE INVENTION

The present invention relates to a warhead enclosing an explosive charge, and more particularly to a warhead including a casing surrounding the charge, a liner for the charge, and a fastening device, including an intermediate ring disposed at the circumference of the liner, for attaching the liner to the casing.

In order to construct warheads having great penetration power, it is often necessary for the liner of the charge, be it a shaped charge or a projectile forming charge, to be composed of a material that is different from that of the warhead casing. If, however, a casing and a liner of different materials are subjected to a thermal stress, for example when working with hot explosives or due to environmental influences, the differences in the coefficient of thermal expansion $\alpha_E$ of the liner and the coefficient of thermal expansion $\alpha_H$ of the casing cause deformations of the liner and of the casing. This may irreversibly move the liner into a position which is asymmetrical relative to the body of the casing so that projectiles resulting from explosive reshaping are asymmetrical and exhibit nonreproducible flight behavior. Such behavior will occur primarily if $\alpha_E < \alpha_H$.

German Patent No. DE 3,441,693.C1 and corresponding U.S. Pat. No. 4,703,695 disclose a device for compensating differences in thermal expansion between an explosive charge and a warhead casing. At least two rings are disposed between the liner base and a component fixed to the casing, with the rings being in contact with one another by way of conical interior or exterior faces, respectively.

The ring having the conical exterior face is composed of a material which has a lower coefficient of thermal expansion than the material of the ring having the conical interior face. The cone angles of the interior and exterior faces, respectively, are matched so that a required length equalization takes place. However, these patent specifications do not disclose a means for compensating for differences in the coefficients of thermal expansion between casing and liner.

SUMMARY OF THE INVENTION

It is therefore an object of the present invention to provide a device for fastening the liner of a shaped charge or a projectile forming charge so as to ensure an unchanging symmetrical and firm seat of the liner in the casing body even where the coefficient of thermal expansion $\alpha_E$ of the liner is smaller than the coefficient of thermal expansion $\alpha_H$ of the casing.

The above and other objects are accomplished in accordance with the invention by the provision of a warhead for an explosive charge, including: a casing for surrounding the charge, the casing having one end presenting a frontal face; a liner having a circumferential area for attachment at the one end of the casing; and an intermediate ring connected to the circumferential area of the liner and having portion which is brought around the frontal face of the casing, the portion having a pressure face which presses against the exterior of the casing and the liner having a coefficient of thermal expansion $\alpha_E$ which is at least as great as the coefficient of thermal expansion oR of the intermediate ring.

BRIEF DESCRIPTION OF THE DRAWINGS

Further details and advantages of the invention will be described below with reference to embodiments thereof which are illustrated in the drawings.

FIG. 5 is a longitudinal sectional view of a warhead equipped with a shaped charge liner and a device for fastening the liner to the charge casing according to the invention.

FIGS. 6 and 7 show two further embodiments, respectively, of the fastening device according to the invention.

DETAILED DESCRIPTION OF THE PREFERRED EMBODIMENTS

Figure 1:
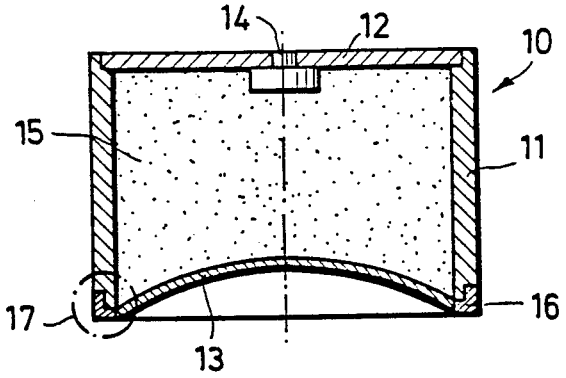
FIG. 1 is a longitudinal sectional view of a warhead equipped with a projectile forming liner and a device for fastening the liner to the charge casing according to the invention.

Referring to FIG. 1, there is shown a warhead 10, its casing 11, a cover plate 12 and a projectile forming liner 13. By way of a transfer and booster charge 14, an explosive charge 15 of warhead 10 is ignited in a known manner. In the illustrated embodiment, projectile forming liner 13 is fastened to casing 11 by way of an L-shaped intermediate ring 16.

Figure 2:
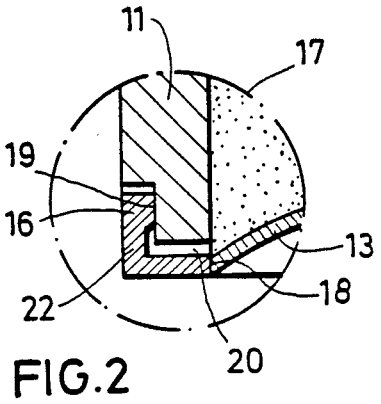
FIGS. 2 and 3 show two embodiments, respectively of the fastening device according to the invention.
Figure 3:
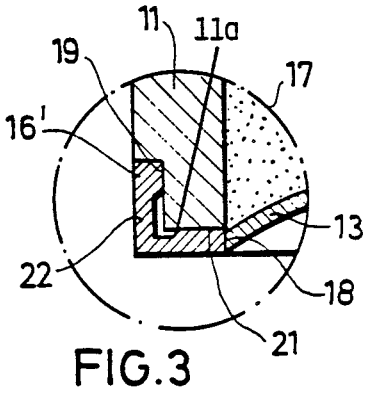

A section of the fastening device for the liner denoted by the circle marked 17 in FIG. 1 is shown in an enlarged view in FIGS. 2 and 3. Referring to these figures, L-shaped intermediate ring is connected with liner 13 by means of a conventional form locking and/or force locking zone 18. Intermediate ring 16 is fastened to casing 11 by releasable or non-releasable connecting means (not shown), for example shrinking or pressing, or by welded or soldered connections, or by screw, or pin connections.

As shown in FIG. 2, intermediate ring 16 has a pressure face 19 with which it presses onto the exterior of casing 11. FIG. 3 differs from 2 only in that, in addition to pressure face 19, intermediate ring 16' (FIG. 3) is provided, in contrast to intermediate ring 16 (FIG. 2), with a slide face 21 at a frontal face 11a of casing 11.

Casing 11 has a coefficient of thermal expansion $\alpha_H$ which should be greater than the coefficient of thermal expansion $\alpha_R$ of intermediate ring 16, 16'. For example, casing 11 may be made of steel and ring 16, 16' of tantalum. The coefficient of thermal expansion $\alpha_E$ of the liner 13, however, should be greater than or equal to the coefficient of thermal expansion $\alpha_R$ of the intermediate ring 16, 16'. Therefore, liner and ring may be made for example, of tantalum or the liner of tantalum and the ring of invar.

Figure 4:
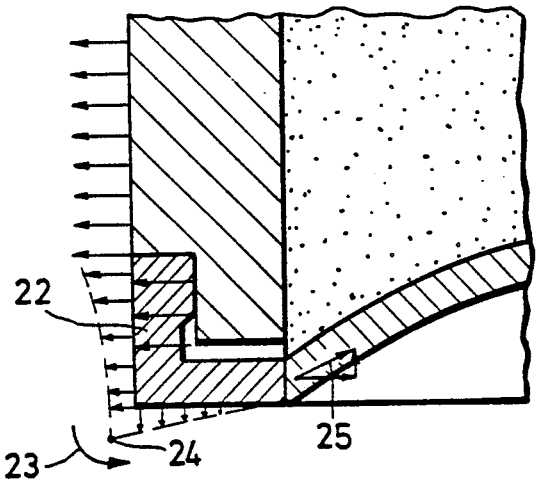
FIG. 4 is an enlarged view of FIG. 2 to describe the operation of the device according to the invention.

The operation of the invention will now be described briefly with reference to FIG. 4.

Since $\alpha_{H>\alpha R}$, casing 11 expands more at elevated temperatures than intermediate ring 16. Due to the greater radial deformation of casing 11, a pressure force is generated in the plane of pressure face 19 which exerts a bending stress on the part of intermediate ring 16 marked 22 and creates a moment 23 about point 24. From this results a radial, inwardly directed holding force 25 on the circumference of ring 16 which holds liner 13 in symmetry with the warhead axis.

If, as shown in FIG. 3, an L-shaped ring 16' is employed which has a slide plane along faces 21 and 11a, there also results a holding force 25 due to moment 23 about point 24. The advantage here is that the arrangement is easier to assemble (ring 16' can be pressed until it abuts at the leading edge of the casing) and a greater fit accuracy is given between liner, casing and ring. Additionally, no explosive is able to collect between the ring and the leading edge of the casing, a fact that is desirable for safety reasons.

FIGS. 5 to 7 show embodiments of a warhead equipped with a shaped charge liner and a further embodiment of a fastening device according to the invention. Of course, a projectile forming liner can also be employed in this case instead of the shaped charge liner. Referring to FIG. 5, there is shown a warhead 30, its casing 31, a liner 32 and a fastening device 33 for fastening liner 32 to casing 31. In this embodiment, a U-shaped intermediate ring is employed instead of the L-shaped ring depicted in FIGS. 1 to 4.

Two embodiments for the arrangement of the casing, U-shaped intermediate ring and liner are shown in FIGS. 6 and 7, respectively, which illustrate an enlarged section of the area in FIG. 1 denoted by circle 34. Referring to FIGS. 6 and 7, there is shown a pin 35 extending from casing 31 surrounded by an intermediate ring 33 or 33', respectively. A customary form or force locking zone 36 is provided between intermediate ring 33, 33' and liner 32. Liner 32 presents a pressure face 37, which performs a similar function as pressure face 19 in FIGS. 1 to 4.

The embodiment of FIG. 7 is similar to that of FIG. 6 except that intermediate ring 33' in FIG. 7 has a slide face 38 which bears against frontal face 35a of pin 35.

The same principle regarding compensation of differences in thermal expansion applies for the U-shaped ring as for the L-shaped ring. If low temperature charges are employed, the connection between ring and liner is ensured in that ring 33, 33' is attached to casing 31 in a pre-tensioned state.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A warhead for enclosing an explosive charge, comprising:

a casing for surrounding the charge, said casing having an end presenting a frontal face;

a liner having a circumferential area for attachment to said end of said casing and a coefficient of thermal expansion $\alpha_E$; and an intermediate ring, having a coefficient of thermal expansion $\alpha_R$, connected to the circumferential area of said liner and having a portion which is brought around said frontal face of said casing, said portion having a pressure face which presses against the exterior of said casing and the coefficient of thermal expansion $\alpha_E$ of said liner being at least as great as the coefficient of thermal expansion $\alpha_R$ of said intermediate ring.

2. A warhead as defined in claim 1, wherein said intermediate ring is L-shaped.

3. A warhead as defined in claim 2, wherein said intermediate ring has a slide face opposite said frontal face of said casing.

4. A warhead as defined in claim 1, wherein said intermediate ring is U-shaped.

5. A warhead as defined in claim 4, wherein said intermediate ring has a slide face opposite said frontal face of said casing.

6. A warhead as defined in claim 1, wherein said casing has a coefficient of thermal expansion $\alpha_H$ which is greater than the coefficient of thermal expansion $\alpha_R$ of said intermediate ring.

7. A warhead as defined in claim 1, wherein said casing is made of steel and said intermediate ring is made of tantalum.

8. A warhead as defined in claim 7, wherein said liner is made of tantalum.

9. A warhead as defined in claim 1, wherein said liner is made of tantalum and said intermediate ring is made of invar.

10. A warhead as defined in claim 1, wherein said charge is a projectile forming charge.

11. A warhead as defined in claim 1, wherein said charge is a shaped charge.

* * * * *